US007845475B2

(12) United States Patent
Lin

(10) Patent No.: US 7,845,475 B2
(45) Date of Patent: Dec. 7, 2010

(54) CONTROLLER FOR MAGNETIC WHEELS

(75) Inventor: Hsien-Mo Lin, Taichung (TW)

(73) Assignee: Her Yuan Chyun Co., Ltd., Taichung (TW)

( * ) Notice: Subject to any disclaimer, the term of this patent is extended or adjusted under 35 U.S.C. 154(b) by 1132 days.

(21) Appl. No.: 11/436,721

(22) Filed: May 19, 2006

(65) Prior Publication Data

US 2007/0281837 A1 Dec. 6, 2007

(51) Int. Cl.
*B60L 7/00* (2006.01)
*A63B 21/005* (2006.01)

(52) U.S. Cl. ..... 188/164; 74/89.2; 482/5; 482/63; 192/56.1

(58) Field of Classification Search ..... 74/501.5 R, 74/89.2, 108; 188/267, 158, 161, 164; 464/37
See application file for complete search history.

(56) References Cited

U.S. PATENT DOCUMENTS 2,637,987 A * 5/1953 Hill et al. ..... 464/37
3,613,356 A * 10/1971 Woodward ..... 303/3
4,766,641 A * 8/1988 Daglow ..... 15/390
4,790,202 A * 12/1988 Hayashi et al. ..... 74/396
5,212,999 A * 5/1993 Kitada ..... 74/425
5,325,736 A * 7/1994 Tsujita ..... 74/425
5,601,491 A * 2/1997 Chan et al. ..... 464/37
5,711,404 A * 1/1998 Lee ..... 188/164
5,777,411 A * 7/1998 Nakajima et al. ..... 310/83
5,823,055 A * 10/1998 Siler ..... 74/425
5,851,165 A * 12/1998 Wei et al. ..... 482/63
6,084,325 A * 7/2000 Hsu ..... 310/74
6,220,415 B1 * 4/2001 Cosenza ..... 192/56.1
6,273,845 B1 * 8/2001 Liou ..... 482/63
6,345,703 B1 * 2/2002 Peng ..... 188/164
6,360,855 B1 * 3/2002 Szu-Yin ..... 188/161
6,457,783 B1 * 10/2002 Schanzenbach et al. .. 303/115.2
6,468,186 B2 * 10/2002 Lay ..... 482/63
6,585,087 B2 * 7/2003 Lin ..... 188/164
6,666,283 B2 * 12/2003 Frauhammer et al. ..... 173/93.5
6,708,796 B2 * 3/2004 Kinme et al. ..... 180/444
6,719,107 B1 * 4/2004 Chen ..... 188/164
6,843,148 B2 * 1/2005 Marcel ..... 74/425
6,867,516 B2 * 3/2005 Frey et al. ..... 310/51
6,952,063 B1 * 10/2005 Chen ..... 310/93
7,018,324 B1 * 3/2006 Lin ..... 482/63
7,051,611 B2 * 5/2006 Fauth ..... 74/425
2002/0020591 A1 * 2/2002 Schanzenbach et al. ..... 188/158
2002/0096005 A1 * 7/2002 Oka et al. ..... 74/388 PS
2002/0112555 A1 * 8/2002 Chikaraishi et al. ..... 74/388 PS (Continued)

*Primary Examiner*—Bradley T King
*Assistant Examiner*—Thomas Irvin
(74) *Attorney, Agent, or Firm*—Egbert Law Offices PLLC

(57) ABSTRACT

The present invention provides a controller for a magnetic wheel, which is added with an alternated adjusting seat within the external rotary disk of the magnetic wheel controller. A flexible locker of alternated adjusting seat can be flexibly locked into second latch groove of external rotary disk. When a cam shaft of a tester has not reached a signal locating point, but the cable of magnetic component has been fixed during initial assembly of the magnetic wheel and controller, the flexible lock is flexibly locked with a second latch groove, such that the external rotary disk and alternated adjusting seat will continue to rotate until the tester senses the locating signal. Thus, no manual adjustment of cable is required in order to shorten assembly time and improve manufacturing efficiency for a higher practicability.

2 Claims, 8 Drawing Sheets

U.S. PATENT DOCUMENTS

2003/0070889 A1* 4/2003 Lin ..... 188/74
2003/0159533 A1* 8/2003 Fauth ..... 74/425
2004/0012280 A1* 1/2004 Frey et al. ..... 310/75 R
2007/0135264 A1* 6/2007 Rosenberg ..... 482/8
2008/0261775 A1* 10/2008 Chang et al. ..... 482/5

* cited by examiner

CONTROLLER FOR MAGNETIC WHEELS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a controller for a magnetic wheel, and more particularly, to an innovative structure with an alternated adjusting seat and screw support component.

BACKGROUND OF THE INVENTION

Magnetic wheels are often applied to fitness equipment (e.g. treadmills) as part of dampening structures. To offer optional resistance for the benefit of different operators of the fitness equipment, a controller is required to adjust the resistance of magnetic wheels in the equipment. The present invention has provided an improved controller, which generally comprises a drive motor, variable gear set, tester and cable-driven wheel. A variable gear set and a cable-driven wheel are activated by the drive motor. In the case of rotation, a cable is pulled by the variable gear set to drive the magnetic component of magnetic wheel, while the cable-driven wheel will actuate a cam shaft of the tester, such that the tester can sense the location of resistance and then transmit a signal to control panel.

However, a typical controller for a magnetic wheel has problems in practice. First, when the drive motor is activated during initial assembly of the magnetic wheel and controller, the cable used to link cable-driven wheel and magnetic wheel has a slight adjusting error because of tightness. Before the cam shaft of tester is rotated in a preset location, the cable has already pulled the magnetic component of the magnetic wheel to this location owing to this error. In such a case, manual fine adjustment of the cable shall be required (note: the cable is often fitted with a micrometer adjusting screw), leading to delay of assembly and lower efficiency in the manufacturing process.

Another problem lies in the transmission between the drive motor and variable gear set. The output shaft of the drive motor is generally provided with a screw, which permits engagement with a first gear set of the variable gear set. Since a screw end is typically suspended without any support structure, axial thrust of a worm gear likely results in unstable deflection, unsmooth operation and mechanical damage or even shorter service life.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The improved efficacy of the present invention is explained in the following. In the prior art, if the pulling state of the cable mismatches the rotating state of a tester cam shaft during initial assembly of the typical magnetic wheel and controller, manual adjustment of the cable is required to avoid delay of assembly works and creates an inefficient manufacturing process. Also, since a screw of the drive motor of the magnetic wheel controller is typically suspended without any support structure, axial thrust of a worm gear likely results in unstable deflection, unsmooth operation and mechanical damage or even shorter service life.

In the present invention, based upon an innovative design, an alternated adjusting seat 90 is added into hollow groove 72 of external rotary disk 70 of a magnetic wheel 10 controller (A). A flexible locker 92 of the alternated adjusting seat 90 can be flexibly locked into a second latch groove 74 of a hollow groove 72. During the initial assembly of the magnetic wheel 10 and controller (A), when cam shaft 61 of tester 60 has rotated to the stop position but a magnetic component 12 of magnetic wheel 10 has not reached the desired location, the drive motor 30 will continue to rotate along with external rotary disk 70. Since flexible locker 92 is flexibly locked into second latch groove 74, external rotary disk 70 and alternated adjusting seat 90 can run alternatively without being influenced by stopped cam shaft 61 of tester 60. So, cable-driven wheel 82 continuously rotates to pull cable 11 and moves magnetic component 12 of magnetic wheel 10 into place for normal operation. No manual adjustment of cable is required, shortening assembly time and improving manufacturing efficiency.

Based upon another innovative design of the present invention, a screw support component 40 is mounted onto housing foundation 20 of controller (A). The end 321 of screw 32 of drive motor 30 can be stably supported for more reliable operation and longer service life of screw 32 and drive motor 30. With adjustable design of screw seat 41, the screw support component 40 can be securely tightened by screw 32, while output shaft 31 of drive motor 30 can be tightly locked to remove the clearance of axial deflection for a more stable rotation. Since the soft liner ring 42 is loosely coupled within receptacle 410 of screw seat 41, and the adhesive is not dried, a slight shift clearance will allow soft liner ring 42 and solid coupling ring 43 to rotate synchronously with output shaft 31 and screw 32 of drive motor 30 for an optimal location. In such case, the adhesive for soft liner ring 42 is dried and soft liner ring 42 positioned. So, it can provide a stable support for screw 32, while making output shaft 31 of drive motor 30 match the central point correctly during rotation.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
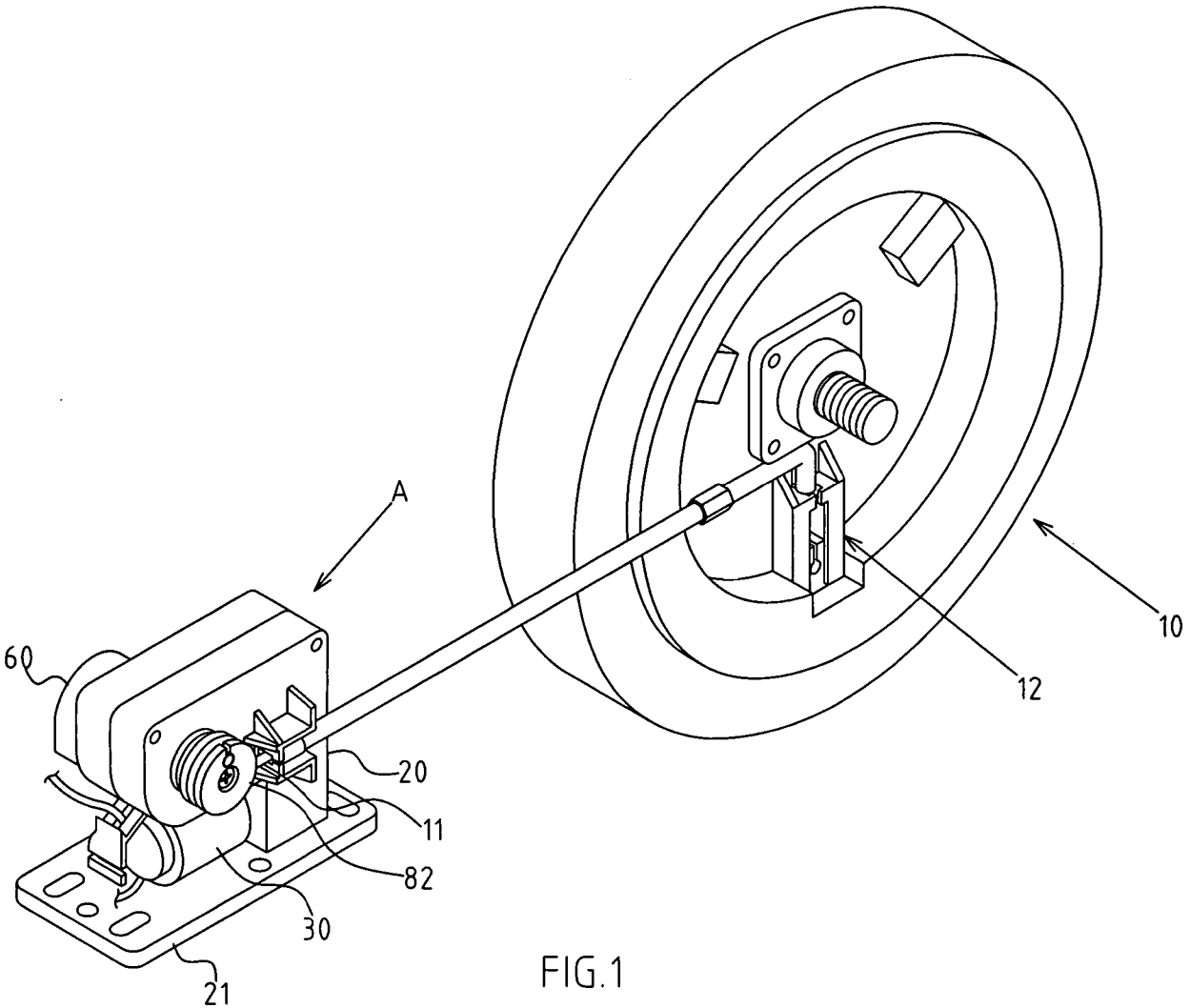
FIG. 1 shows a perspective view of the assembly of a controller and a magnetic wheel of the present invention.
Figure 2:
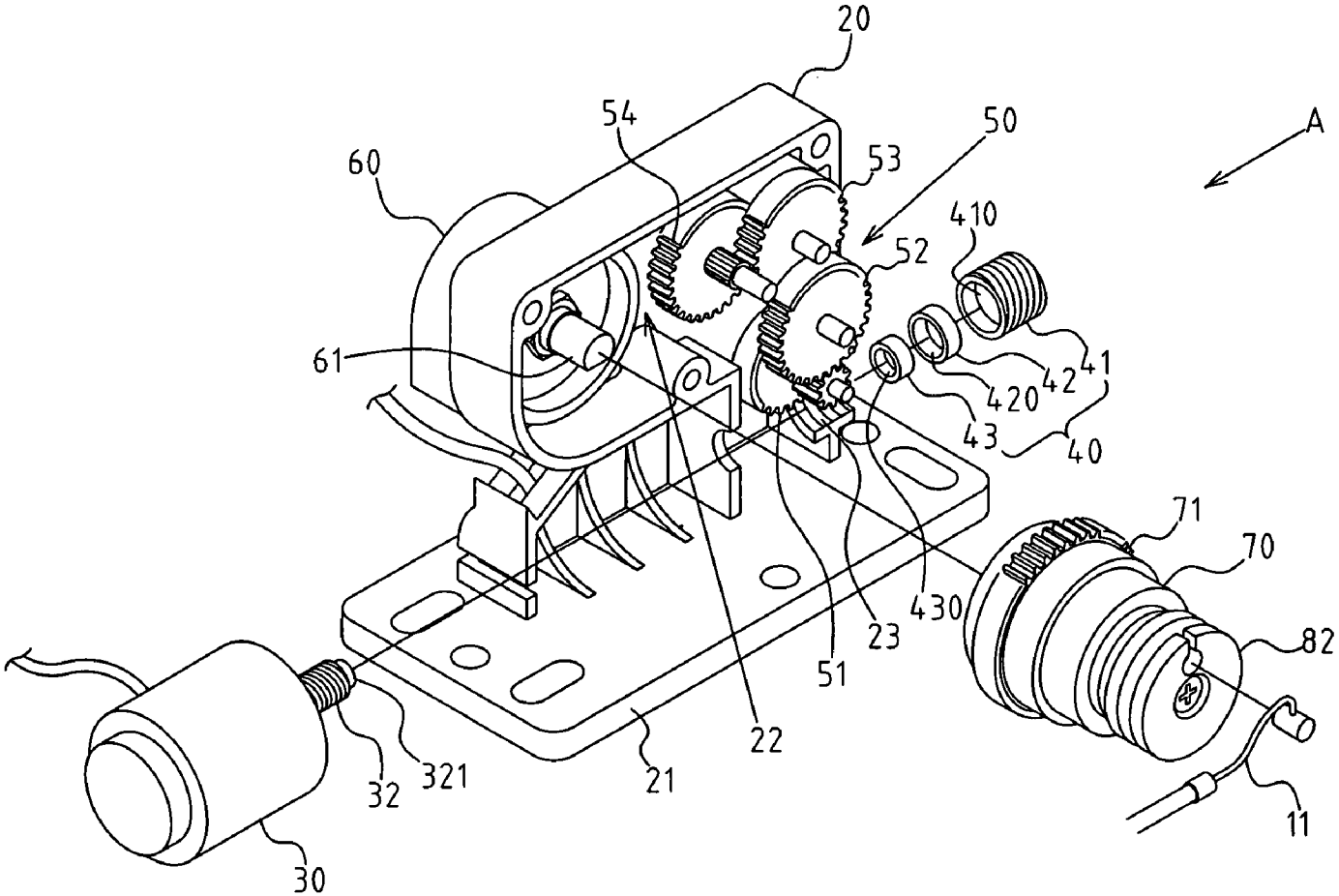
FIG. 2 shows an exploded perspective view of the controller unit of the present invention.

FIGS. 1, 2 depict preferred embodiments of magnetic wheel controllers of the present invention, which, however, are provided for only explanatory purposes regarding the claims. The magnetic wheel 10 is generally applied to fitness equipment (e.g. treadmills) as part of dampening structures. The controller (A) is used to regulate the resistance of a magnetic wheel 10.

The present invention includes a housing foundation 20, which has a mounting plate 21 (e.g. a bolt-punched hole), whereby it is permanently placed into a preset location of the fitness equipment. A space 22 is reserved within housing foundation 20 to accommodate structural members.

Figure 4:
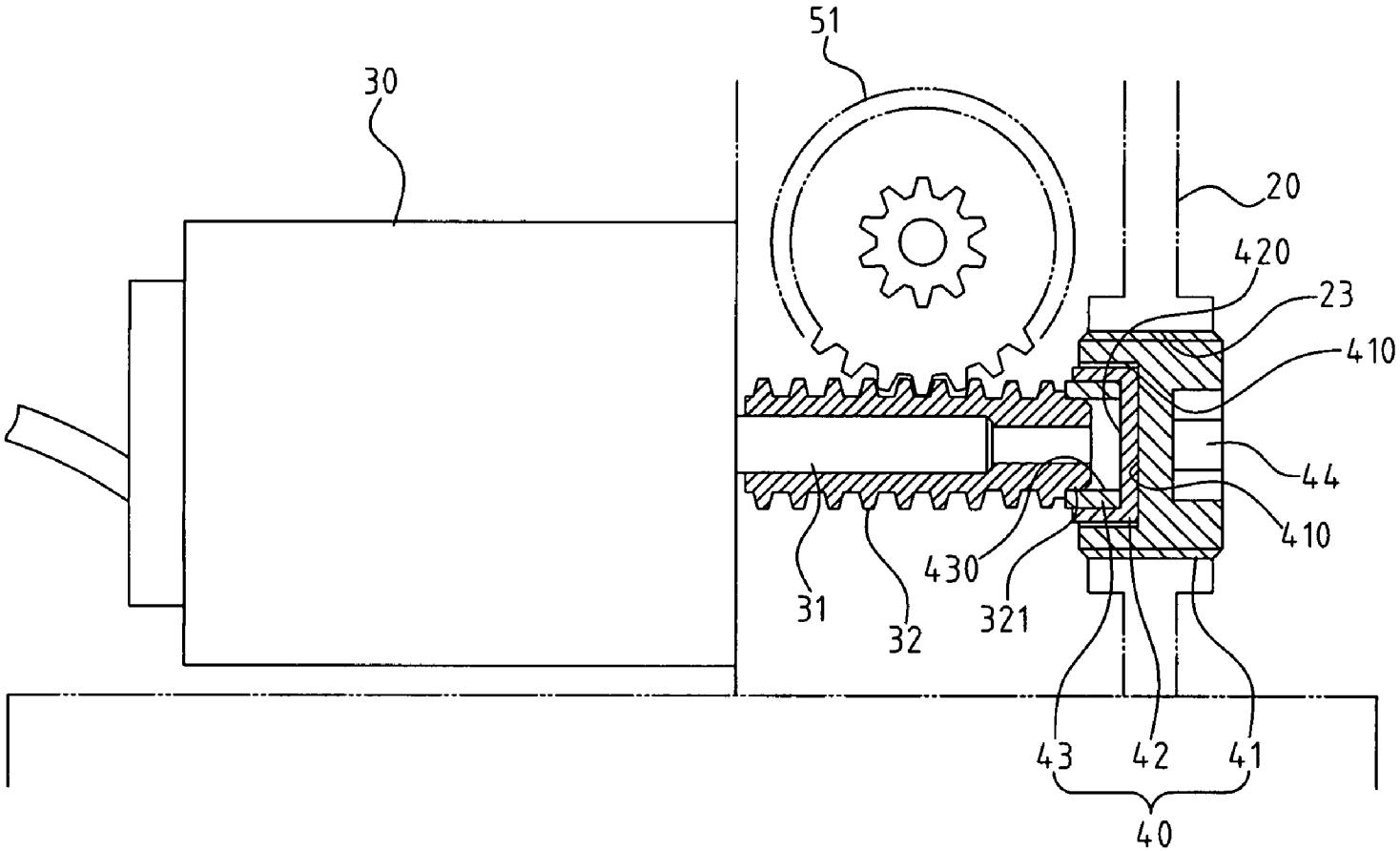
FIG. 4 shows an axial sectional view of the screw support component of the present invention.

The structural members include a drive motor 30, which is mounted into the space 22 of housing foundation 20, and an output shaft 31 of drive motor 30 (as shown in FIG.4) is fitted with a screw 32.

Figure 3:
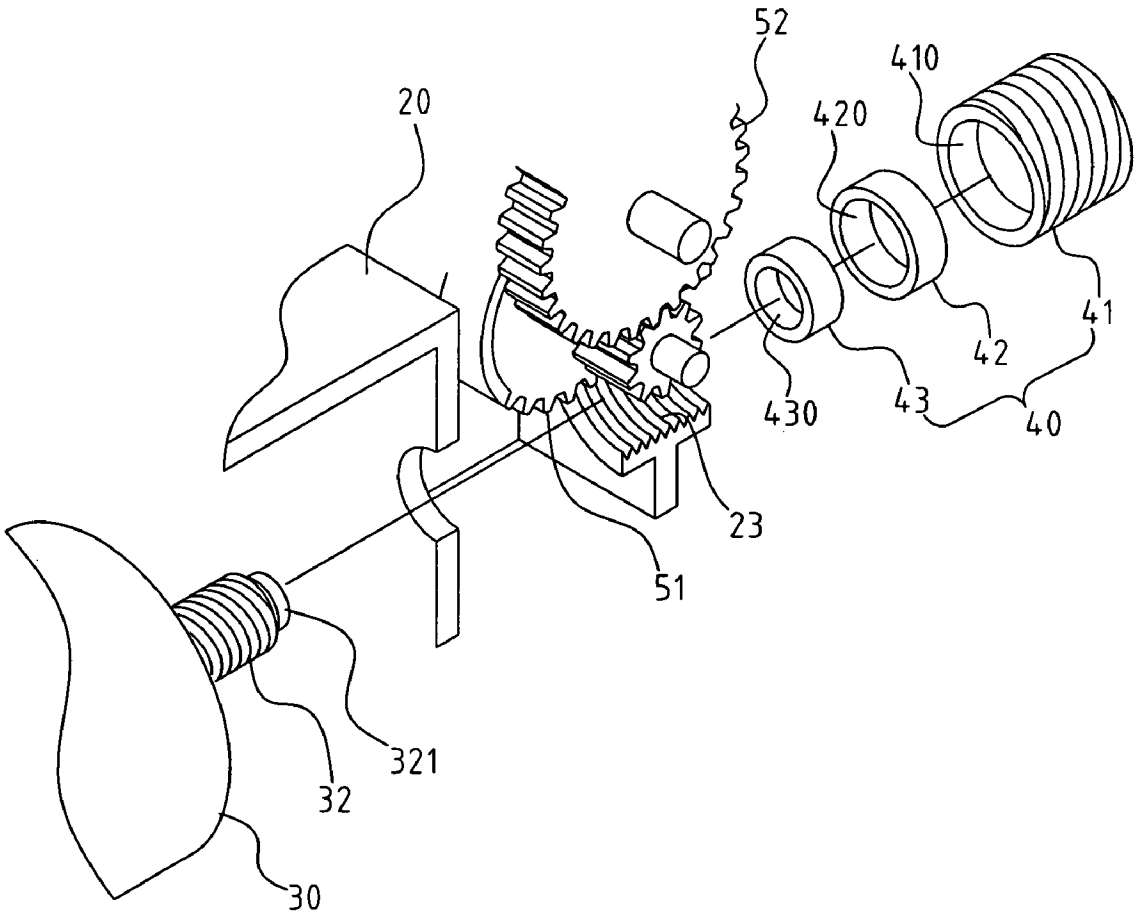
FIG. 3 shows an exploded perspective view of the screw support component of the present invention.

A screw support component 40, as shown in FIGS. 3, 4, is mounted at housing foundation 20 opposite to the end 321 of screw 32 of drive motor 30. The screw support component 40 includes a screw seat 41 and a support component. The support component includes a soft liner ring 42 and a solid coupling ring 43. The screw seat 41 is screwed into a bolt hole 23 of housing foundation 20 for flexible adjustment. At one end of screw seat 41 facing the end 321 of screw 32, a receptacle 410 is mounted to enable interpolation of soft liner ring 42. The solid coupling ring 43 is embedded into a hole 420 of soft liner ring 42. The end 321 of screw 32 can be interpolated into hole 430 of the solid coupling ring 43, thus providing a stable support for the end 321 of screw 32. At the external surface of screw seat 41, a groove 44 is provided for interpolation of tools (e.g. inner hexagon spanner). A soft liner ring 42 can be adhered into the receptacle 410 of screw seat.

Figure 6:
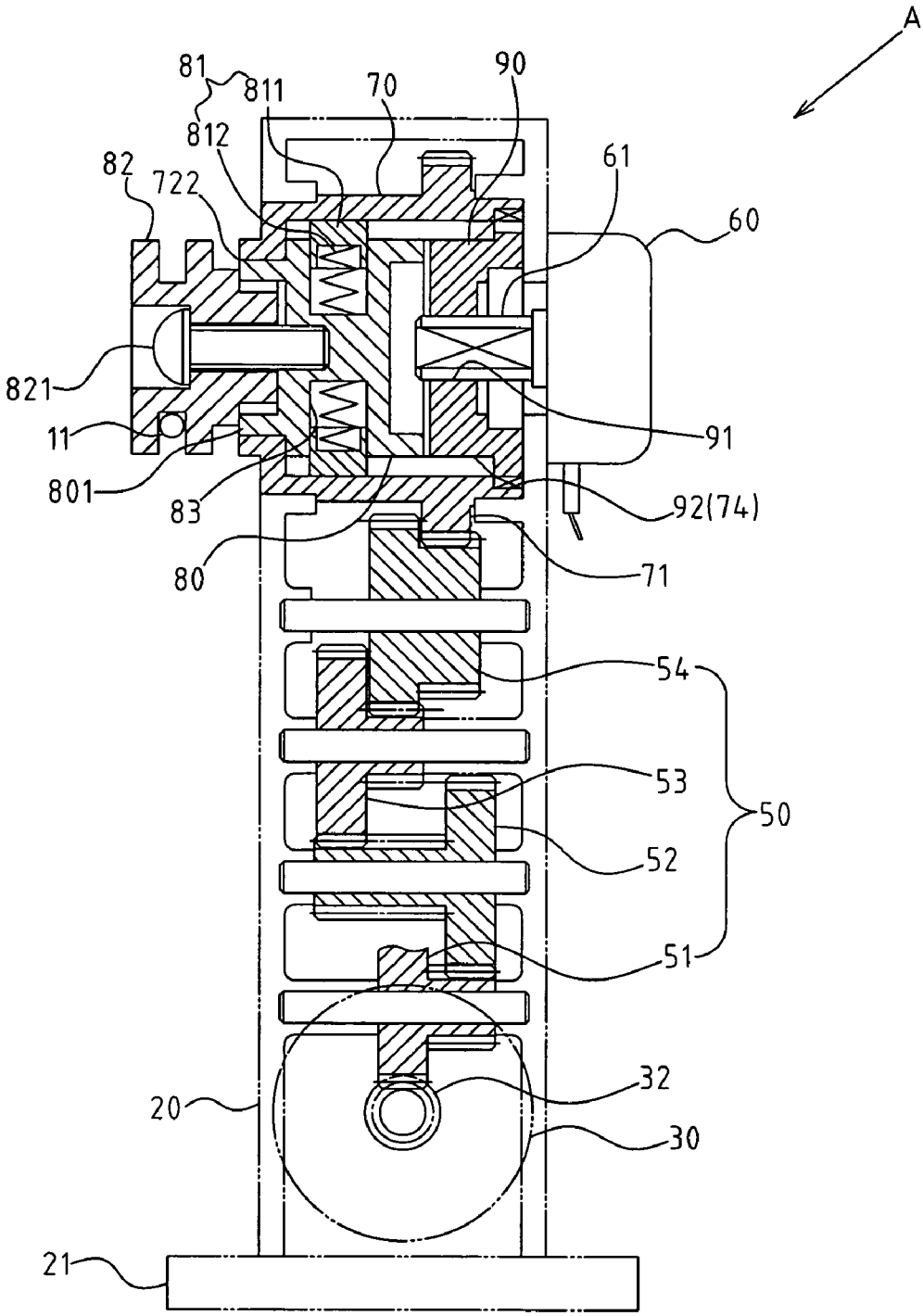
FIG. 6 shows a sectional view of the variable gear set of the present invention.

A variable gear set 50, as shown in FIGS. 2, 6, comprises several gear sets with a preset gear ratio, of which the first gear set 51 is coupled with screw 32 of drive motor 30. A variable gear set 50 of the present invention contains four gear sets 51, 52, 53, 54.

Figure 7:
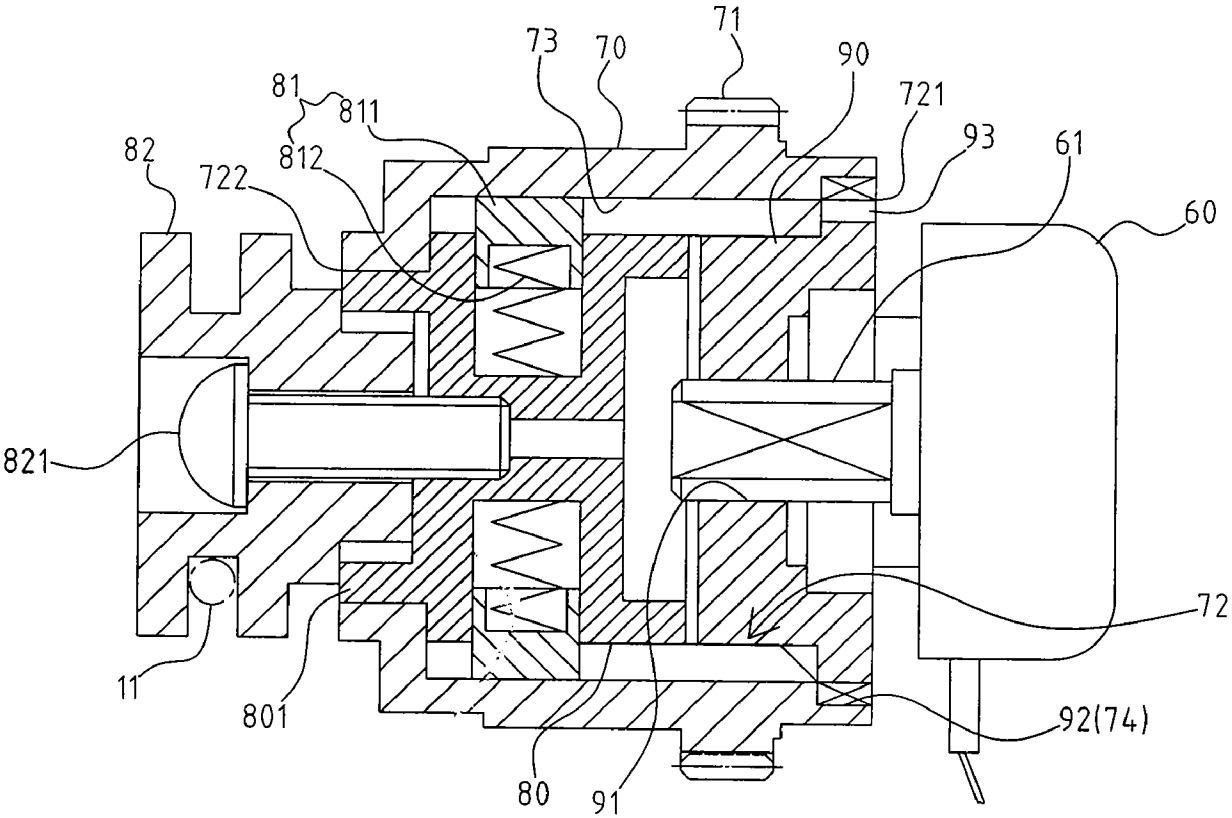
FIG. 7 shows a sectional view of the external rotary disk of the present invention.

A tester 60, as shown in FIGS. 2, 6, 7, is mounted at a back of a drive of variable gear set 50, but not directly linked to variable gear set 50. A cam shaft 61 of tester 60 is installed within space 22 of housing foundation 20.

Figure 5:
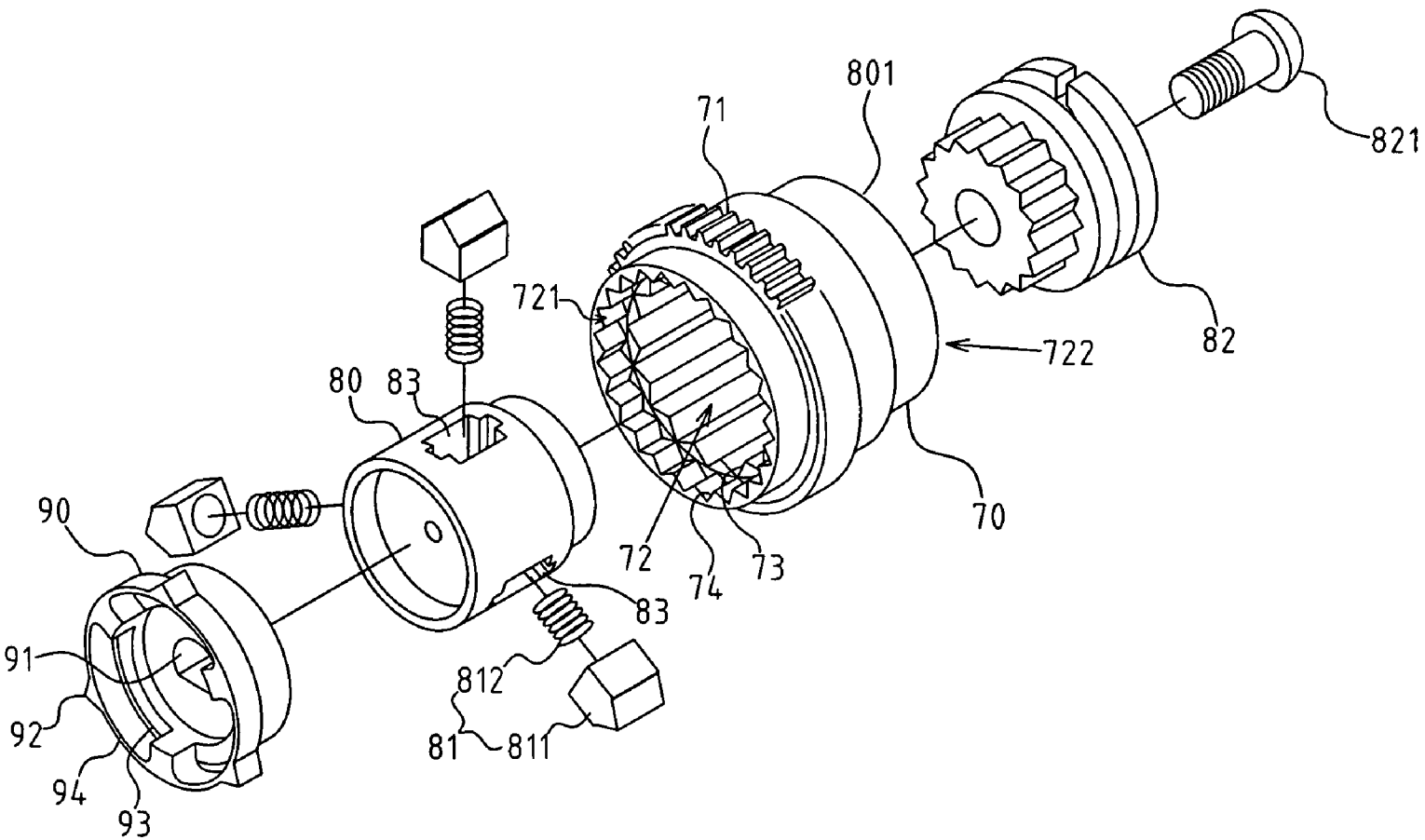
FIG. 5 shows an exploded perspective view of the external rotary disk of the present invention.

An external rotary disk 70, as shown in FIGS. 2, 5, 7, is mounted at a back of a drive of variable gear set 50. A gear tooth 71 of external rotary disk 70 is coupled with the fourth gear set 54 of variable gear set 50 (the last gear set), and a hollow groove 72 is placed within external rotary disk 70, with an inner punch hole 721 and an external punch hole 722 at both ends. The inner punch hole 721 is placed oppositely to cam shaft 61 of tester 60, and a first latch groove 73 is located within hollow groove 72. A second latch groove 74 is located at inner punch hole 721 of hollow groove 72.

An inner rotary disk 80, as shown in FIGS. 5, 6, 7, is mounted within hollow groove 72 of external rotary disk 70. A flexible snapper 81 outside of inner rotary disk 80 is flexibly locked into latch groove 73 of external rotary disk 70. The outer end 81 of inner rotary disk 80 can be screwed into external punch hole 722 of hollow groove 72, and equipped with a cable-driven wheel 82. The cable-driven wheel 82 of the present invention is located at outer end 801 of the inner rotary disk 80 via a bolt 821, thus allowing for linking of cable 11 of magnetic wheel 10. The other end of the cable 11 is connected to magnetic component 12 of magnetic wheel 10 (as shown in FIG. 1). The aforesaid flexible snapper 81 comprises a liner lock 811 with conical points and a spring 812 for liner lock 811. Several receptacles are alternatively arranged around inner rotary disk 80 to accommodate the aforementioned liner lock 811 and spring 812.

Figure 9:
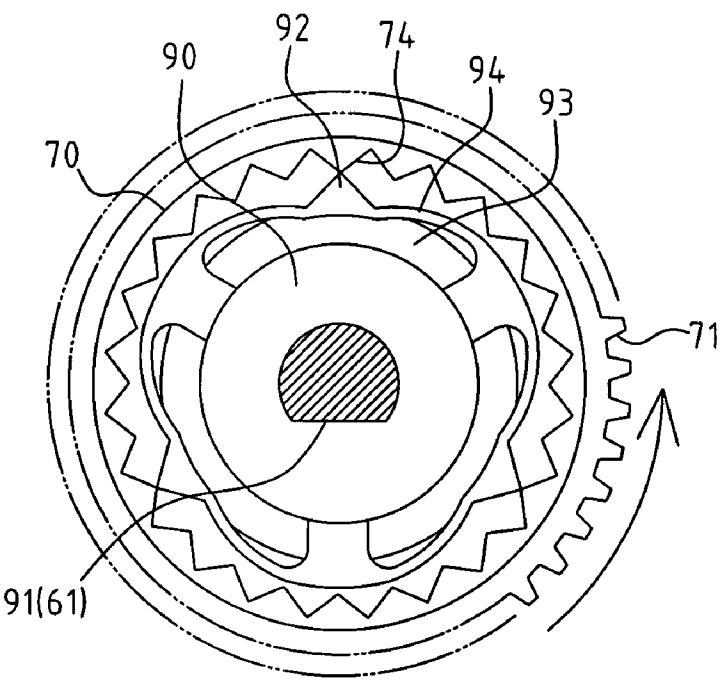
FIG. 9 shows a front schematic view of the alternated adjusting seat alternatively arranged with external rotary disk of the present invention.
Figure 8:
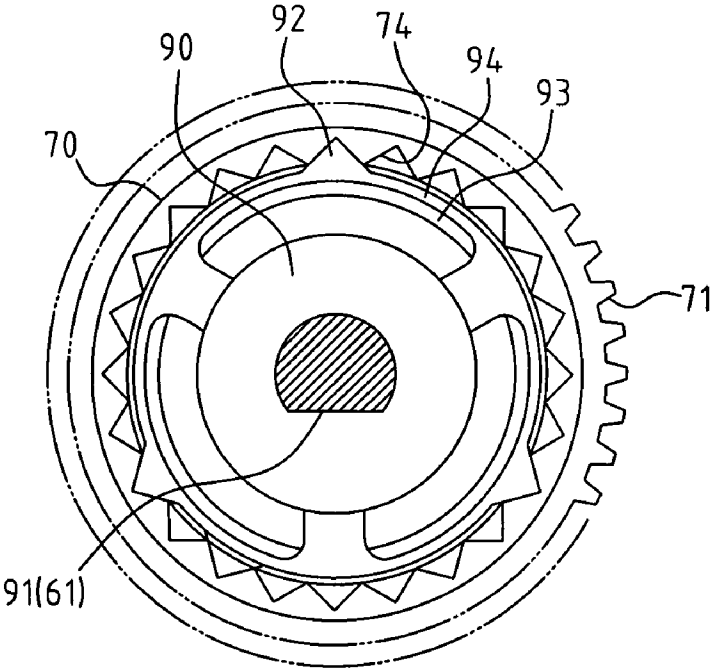
FIG. 8 shows a front schematic view of the alternated adjusting seat locked with external rotary disk of the present invention.

An alternated adjusting seat 90, as shown in FIGS. 5, 6, 7, is mounted centrally within hollow groove 72 of external rotary disk 70. At the center of alternated adjusting seat 90, a non-circular mounting hole 91 is fixed onto cam shaft 61 of tester 60, such that cam shaft 61 is driven synchronously by alternated adjusting seat 90. A flexible locker 92 is mounted externally at alternated adjusting seat 90 to enable flexible locking with second latch groove 74 of hollow groove 72. Flexible locker 92 is alternatively provided with some bulge teeth. At inner space of alternated adjusting seat 90 opposite to flexible locker 92, a rectangular hollow groove 93 is provided to form a flexible frame 94, such that flexible lockers 92 can retract flexibly (as shown in FIG.9).

Among which, variable gear set 50 of the present invention comprises four gear sets (shown in FIGS. 2, 6) with the following gear ratios: the gear ratio of first gear set 51 versus speed ratio of screw 32 is 34:1; gear ratio of second gear set 52 versus first gear set 51 is 44:12; gear ratio of third gear set 53 versus second gear set 52 is 36:13; gear ratio of fourth gear set 54 versus third gear set 53 is 27:16; and gear ratio of gear tooth 71 of external rotary disk 70 versus fourth gear set 54 is 48:20. Assuming drive motor 30 has 5000 revolutions (circles), the gear ratio is computed using the following formula:

$$5000 * \frac{1}{34} * \frac{12}{44} * \frac{13}{36} * \frac{16}{27} * \frac{20}{48} = 3.57$$

Where, gear tooth 71 of external rotary disk 70 has 3.57 revolution.

Based on above-specified structural design, the major purpose of the present invention is to add an alternated adjusting seat 90, which facilitates the assembly of magnetic wheel 10 and controller (A).

Referring to FIG. 1, when drive motor 30 is activated for initial assembly of magnetic wheel 10 and controller (A), external rotary disk 70 will be driven by screw 32 and variable gear set 50 (as shown in FIGS. 6, 7). In that case, the locking state of flexible snapper 81 enables inner rotary disk 80 and cable-driven wheel 82 to be rotated synchronously. In the case of rotation of cable-driven wheel 82, a cable 11 is pulled to adjust the magnetic resistance of the magnetic wheel. On the other hand, the locking state of flexible locker 92 and second latch groove 74 enables alternated adjusting seat 90 to be rotated synchronously with external rotary disk 70.

After completion of initial assembly, cable 11 has generated an adjusting error of tightness. Before cam shaft 61 of tester 60 reaches the signal locating point, the cable 11 of the magnetic component of the magnetic wheel has already reached this location (or section) owing to this error. With addition of alternated adjusting seat 90, the drive motor 30 will continuously rotate together with external rotary disk 70. Since flexible locker 92 is flexibly locked into second latch groove 74, external rotary disk 70 and alternated adjusting seat 90 can move alternatively (as shown in FIG.9), such that external rotary disk 70 and alternated adjusting seat 90 will continue to rotate until tester 60 senses the locating signal. Therefore, no manual adjustment of cable is required for calibration, and magnetic component 12 of magnetic wheel 10 will not generate invalid sections against normal functioning.

Additionally, when the controller (A) is operated, magnetic component 12 of magnetic wheel 10 has already been driven in place by cable-driven wheel 82. If drive motor 30 continues to operate owing to signal errors or other factors, and when drive torque of external rotary disk 70 exceeds the supporting force of flexible snapper 81, inner and external rotary disks 70, 80 will run alternatively to avoid excessive rotation of drive motor 30 to result in damage of variable gear set 50. This is based on the design that flexible snapper 81 of inner rotary disk 80 is flexibly locked into latch groove 73 of external rotary disk 70. Thus, the alternative operation of flexible snapper 81 differs from that of alternated adjusting seat 90 occurred only during first assembly.

Referring to FIG.4, another major design of the present invention is a screw support component 40. During assembly, soft liner ring 42 and a solid coupling ring 43 are mounted into tanker 410 of screw seat 41, of which soft liner ring 42 can be adhered in advance. Next, the screw seat 41 is screwed into bolt hole 23 of housing foundation 20, until hole 430 of solid coupling ring 43 stops at the end 321 of screw 32. Thus, output shaft 31 of drive motor 30 can be tightly locked to remove the clearance of axial deflection for a more stable rotation. Next, drive motor 30 is allowed for operation. Since the soft liner ring 42 is loosely coupled with tanker 410 of screw seat 41, and the adhesive is not dried, a slight shift clearance will allow soft liner ring 42 and solid coupling ring 43 to rotate synchronously with output shaft 31 and screw 32 of drive motor 30 until optimal location. In such case, the adhesive for soft liner ring 42 is dried and soft liner ring 42 positioned. So, it can provide a stable support for screw 32, while making output shaft 31 of drive motor 30 matches correctly the central point during rotation.

I claim:

1. A controller apparatus for regulating a resistance of a magnetic wheel having a cable connected thereto, the controller apparatus comprising:

a housing foundation having a space therein, said housing foundation having a mounting plate;

a drive motor mounted in said space of said housing foundation, said drive motor having an output shaft, said output shaft having a screw thereon;

a screw support component mounted on said housing foundation opposite to an end of said screw of said output shaft, said screw support component having a screw seat and a support, said screw seat being adjustably screwed into a bolt hole of said housing foundation, a receptacle being mounted at an end of said screw seat facing said end of said screw so as to allow adjustable insertion of said support therein;

a variable gear set having a plurality of gears with a gear ratio, one of said plurality of gears being coupled to said screw of said drive motor;

a tester mounted at a back of said variable gear set but not directly linked to said variable gear set, said tester having a cam shaft positioned within said space of said housing foundation;

an external rotary disk mounted at said back of said variable gear set, said external rotary disk having a gear tooth coupled to another gear of said plurality of gears of said variable gear set, said external rotary disk having a hollow groove therein, said external rotary disk having an inner punch hole positioned opposite said cam shaft of said tester and an external punch, said external rotary disk having a first latch groove positioned in said hollow groove and a second latch groove positioned at said inner punch hole of said hollow groove;

an inner rotary disk mounted within said hollow groove of said external rotary disk, said inner rotary disk having a flexible snapper on an outside thereof, said flexible snapper being flexibly locked into said first latch groove of said external rotary disk, said inner rotary disk having an outer end screwed into said external punch hole of said hollow groove, said inner rotary disk having a cable-driven wheel suitable for linking to the cable of the magnetic wheel, said tester suitable for measuring a travel of the cable;

an alternated adjusting seat mounted centrally within said hollow groove of said external rotary disk, said alternated adjusting seat having a mounting hole at a center thereof, said mounting hole fixed onto said cam shaft of said tester; and a flexible locker mounted externally on said alternated adjusting seat so as to flexibly lock with said second latch groove, said screw support component comprises a soft liner ring and a solid coupling ring, said solid coupling ring is embedded into a hole of said soft liner ring so as to allow for insertion of said end of said screw of said drive motor, said soft liner ring is adhered to said receptacle of said screw seat, wherein adjacent flexible locker has bulge teeth, said alternated adjusting seat having an inner space opposite to said flexible locker, said inner space having a rectangular hollow groove therein so as to form a flexible frame so as to allow said flexible locker to flexibly retract.

2. The controller of apparatus of claim 1, wherein an outer end of said screw seat has a groove therein.

* * * * *